US007930900B2

(12) United States Patent
Kim-Araneo

(10) Patent No.: US 7,930,900 B2
(45) Date of Patent: Apr. 26, 2011

(54) CHARM CLASP FOR PEARL NECKLACES AND BRACELETS

(75) Inventor: Amy Kim-Araneo, Long Island City, NY (US)

(73) Assignee: Mikimoto (America) Co., Ltd., New York, NY (US)

( * ) Notice: Subject to any disclaimer, the term of this patent is extended or adjusted under 35 U.S.C. 154(b) by 322 days.

(21) Appl. No.: 12/156,977

(22) Filed: Jun. 6, 2008

(65) Prior Publication Data

US 2009/0301134 A1 Dec. 10, 2009

(51) Int. Cl.
*A44C 17/02* (2006.01)

(52) U.S. Cl. ..... 63/23; 16/21; 16/33; 16/40

(58) Field of Classification Search ..... 24/116 R, 24/116 A, 327, 598.5, 600.1, 376, 573.11, 24/574.1, 580.1; 63/3.1, 9, 23, 40, 15, 21, 63/33; D11/26, 27

See application file for complete search history.

(56) References Cited

U.S. PATENT DOCUMENTS

| | | | | | |
|---|---|---|---|---|---|
| 238,998 | A | | 3/1881 | Wallach | |
| 725,322 | A | * | 4/1903 | Davis | 63/9 |
| 1,087,015 | A | * | 2/1914 | Heylmun | 63/1.13 |
| 1,262,419 | A | | 4/1918 | White | |
| 1,269,491 | A | * | 6/1918 | Murray | 131/258 |
| 1,522,297 | A | * | 1/1925 | Godsol | 40/662 |
| D109,800 | S | * | 5/1938 | Foss | D11/32 |
| 2,292,563 | A | * | 8/1942 | Imhoff | 70/458 |
| 2,296,084 | A | * | 9/1942 | Bloom et al. | 24/3.13 |
| 2,771,753 | A | * | 11/1956 | Sallan | 63/15.7 |
| 3,221,514 | A | * | 12/1965 | Newman | 63/15.7 |
| 3,404,440 | A | | 10/1968 | Weiss | |
| 3,423,956 | A | * | 1/1969 | Moe | 63/15.45 |
| 3,736,770 | A | * | 6/1973 | Kelrick | 63/15.7 |
| 4,314,389 | A | | 2/1982 | Sauer et al. | |
| 4,530,221 | A | | 7/1985 | Weinberg | |
| 4,790,148 | A | * | 12/1988 | Faini | 63/15.7 |
| 4,815,180 | A | | 3/1989 | Elsener | |
| D309,277 | S | * | 7/1990 | Mejias | D11/27 |
| 5,412,956 | A | * | 5/1995 | Levy | 63/15.65 |
| 6,125,657 | A | * | 10/2000 | Esposito | 63/12 |
| 7,007,507 | B2 | | 3/2006 | Enevoldsen | |
| 7,347,065 | B1 | * | 3/2008 | DeGolyer | 63/7 |
| 2004/0194503 | A1 | | 10/2004 | Schnitman | |

* cited by examiner

*Primary Examiner* — Thomas B Will
*Assistant Examiner* — Emily Morgan
(74) *Attorney, Agent, or Firm* — Abelman, Frayne & Schwab

(57) ABSTRACT

A charm clasp having a torus shape and formed as two pivotally connected arcuate parts which are adapted to encircle and releasably attach to a segment of a necklace formed as a strand of pearls, this clasp including an eyelet for attachment of a charm thereto.

17 Claims, 4 Drawing Sheets

CHARM CLASP FOR PEARL NECKLACES AND BRACELETS

I. BACKGROUND

A. Field of the Invention

Figure 1:
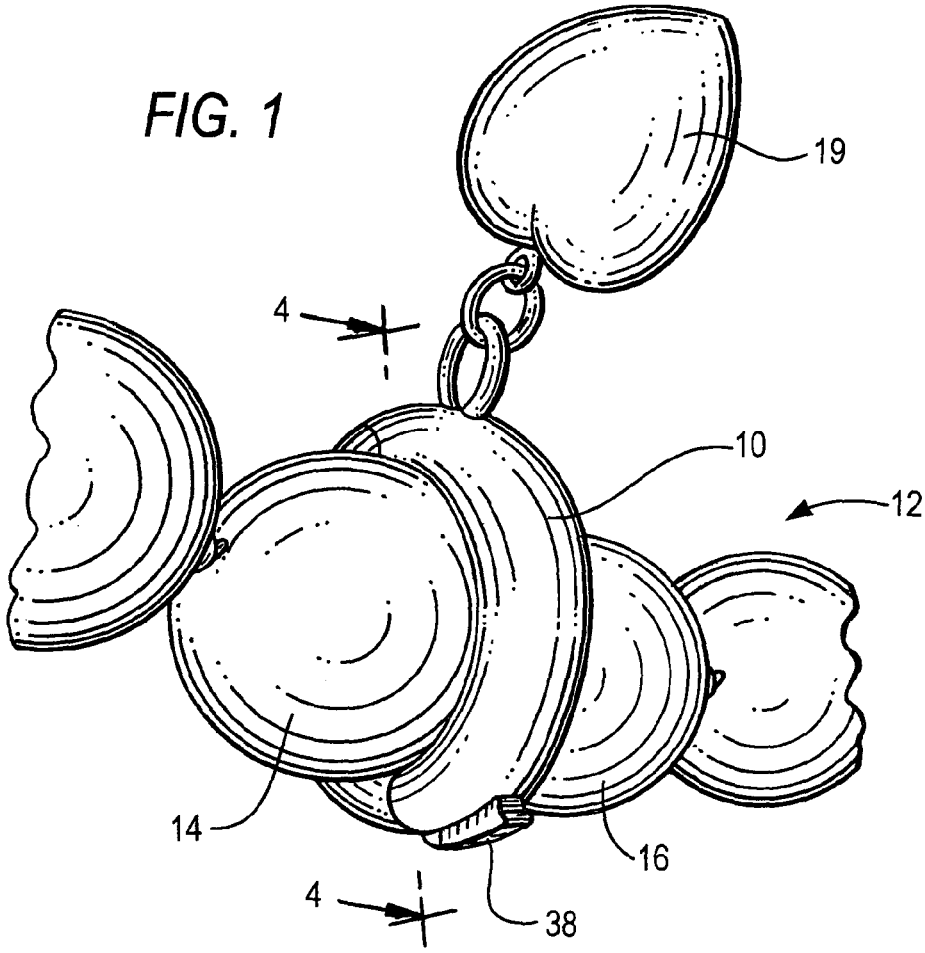

This invention is in the field of jewelry in the form of necklaces and bracelets and particularly clasps for releasably coupling charms to a pearl necklace or pearl bracelet.

B. Background of the Invention

This invention is in the field of necklaces and bracelets formed of strands of beads, and particularly necklaces and bracelets formed as strands of pearls. While beads of regular and irregular or even random shapes are well known, one of the universally popular shapes of beads in necklaces is spheres, and some of the most coveted spheres are pearls. As is well known, pearl necklaces and bracelets are available with pearls of many different qualities and sizes and of different lengths, and with mating coupling elements at the opposite ends of each strand for releasably joining these ends.

The present invention is concerned primarily with strands of pearls, which may be valuable cultured pearls or synthetic pearls or strands of other spherical elements including inexpensive beads of natural or man-made materials. In all these strands, the pearl or bead element has a hole drilled or otherwise formed through its center through which a cord is threaded to create the strand, and spacer elements are generally situated on the strand between each two adjacent pearls or beads. Such a spacer element may be a knot formed in the strand itself or may be a small independent element having its own central bore hole through which the cord is threaded. If the spacer element is spherical or generally spherical, the dimension of the space between beads established by such spacer element will be the diameter of the spacer element. The size of such space is a matter of design and aesthetic choice as regards the dimensional relationship of the spacer to the bead.

While pearl necklaces are generally appreciated for their simple elegance, as where the pearls are essentially identical in size, color and spacing, the present invention provides an opportunity for persons who wear pearl necklaces or bracelets to personalize or creatively modify the appearance of such necklaces or bracelets by attaching a charm or other decorative element of personal choice to the strand. Such charms should be easily attachable and removable to return the necklace to it original design or removable to allow attachment of a different charm. Clasps or attachment means take various forms; however, all known prior art clasps create awkward looking extensions from the simple and pure elegance of a typical and basic strand of pearls. Known clasps have shapes totally different from and esthetically incompatible and conflicting with the original simple elegance of a strand of pearls as seen in prior art patents, U.S. Pat. Nos. 4,314,389, 4,530,221, 4,815,180, 7,007,507 and US2004/0194503. The present invention addresses this problem and provides a solution that is both practical and esthetically compatible with the basic strand of pearls appearance.

In the U.S. Pat. No. 4,314,389 of the above-noted prior art publications, a jewelry clasp of generally rectangular shape releasably joins opposite ends of a necklace; in the U.S. Pat. No. 4,530,221 a round cylindrical can-like device fully encompasses a single pearl with a flat blade spring element to releasably capture the pearl in the container; in the U.S. Pat. No. 4,815,180 a ring shaped jewelry clasp is formed of two half-rings connected by a single pivot joint and a single snap clasp, and no additional internal latching element; in the published application US2004/0194503 A1 a pearl necklace clasp is formed generally as a cage that encompasses a single pearl while leaving substantial areas of the pearl surface to be visible; and in the U.S. Pat. No. 3,736,770 an adjustable ring latch has one arcuate arm that slides circumferentially within and engages a mating arcuate arm.

Each of these prior art devices has its own specific function, but none is even close to having the objectives, function, structure and aesthetic harmony with a strand of pearls, as occurs with the present invention. More particularly, features of the preferred embodiments of the jewelry clasp of the present invention include:

(a) a torus-shaped ring, (b) dual latches where the outer latch covers, protects and bars the inner latch from opening unless the outer latch is first opened, (c) formation of a closed ring by each of the latch arms, independently of the other, (d) the hiding of the inner latch arm within the outer arm, (e) the outer latch arm combining with a base arm to form a complete torus, (f) the entire torroid clasp having an appearance that so conforms to the spherical pearls it encompasses, to appear to some as a natural compliment or component element of the strand of pearls it engages, (g) the clasp securely engaging the strand of pearls at a location that covers only a portion of adjacent ends of two adjacent pearls, while leaving the major parts of the pearls fully visible, (h) the two latches being easy to operate, secure, but having their respective hook or catch portions essentially invisible; and (i) having release projections easily accessible.

The above-described features of the new invention constitute some of the many distinctions and advantages of this invention applied separately or in selected combinations over the known prior art. Some of these distinctions are further presented below in the recitations of objects of this invention.

II. OBJECTS AND SUMMARY OF THE NEW INVENTION

A first object of the new invention is to provide a charm clasp or coupling device for releasably attaching a charm or other decorative element to a strand of pearls.

A further object is to provide a charm clasp for releasably attaching a charm to a strand of pearls where such clasp has an outer shape is esthetically compatible with said strand of pearls, and in a preferred embodiment is a torus shaped collar that encircles a segment of the strand, and more particularly encircles the adjacent ends of two adjacent pearls of a strand.

A still further object is to provide a charm clasp that can be releasably engaged to a strand of pearls easily and quickly, and yet provides reliable security from being unintentionally disengaged.

An additionally object is to provide a charm clasp that will conform generally to the shape of the pearls such a torus or other circular collar.

Another object is to provide a charm clasp that will releasably engage the strand without damaging the pearls The invention accordingly comprises the features of construction, combination of elements, and arrangements of parts which will be exemplified in the construction hereinafter set forth, and the scope of the invention will be indicated in the claims.

III. BRIEF DESCRIPTION OF THE DRAWINGS

Figure 2:
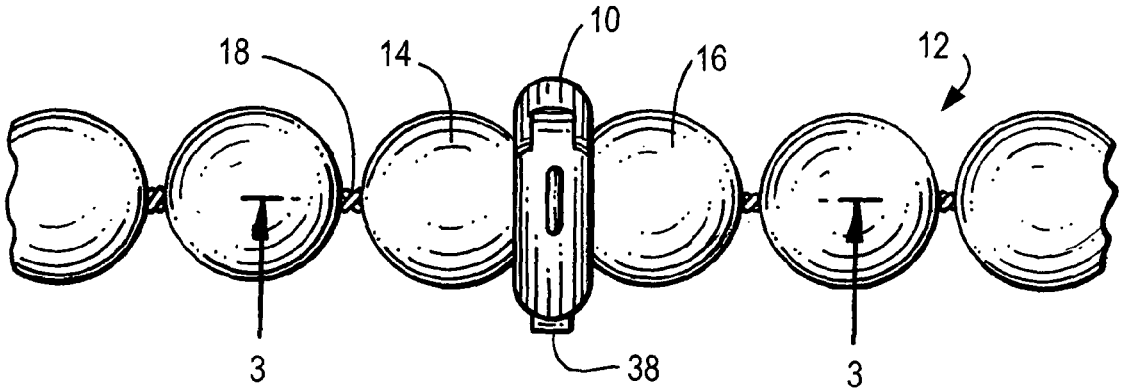
Figure 3:
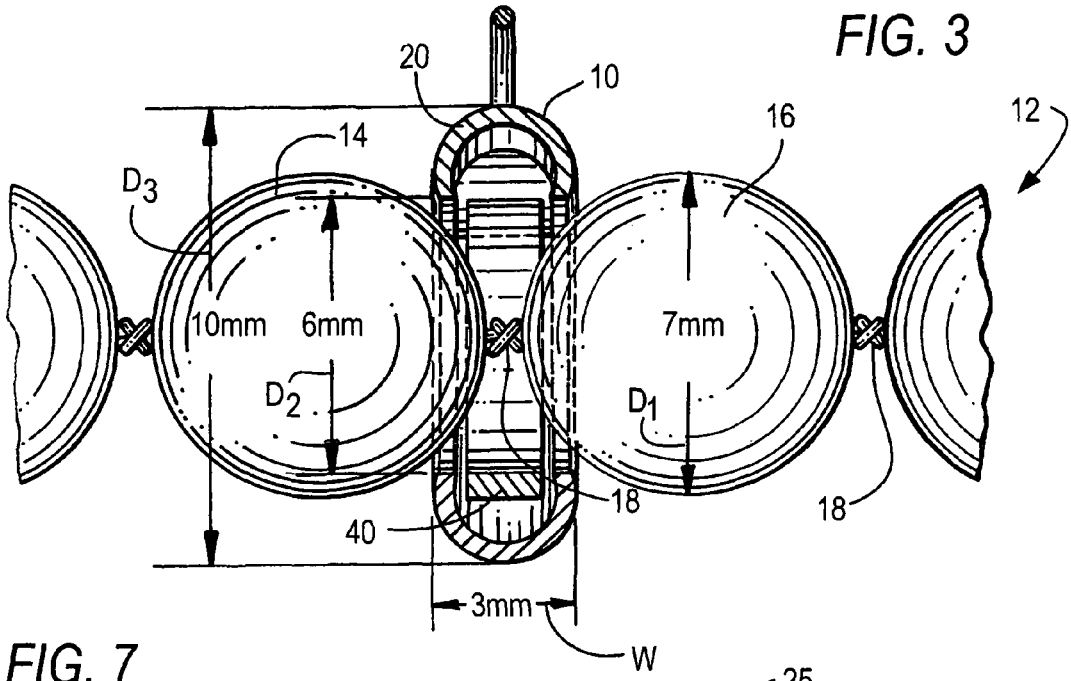
Figure 7:
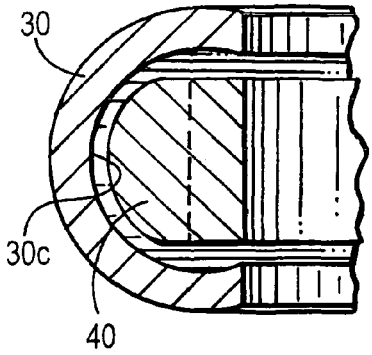
Figure 8:
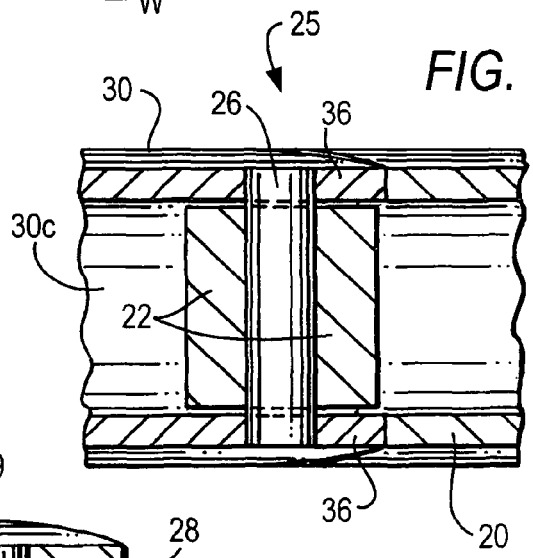
Figure 9:
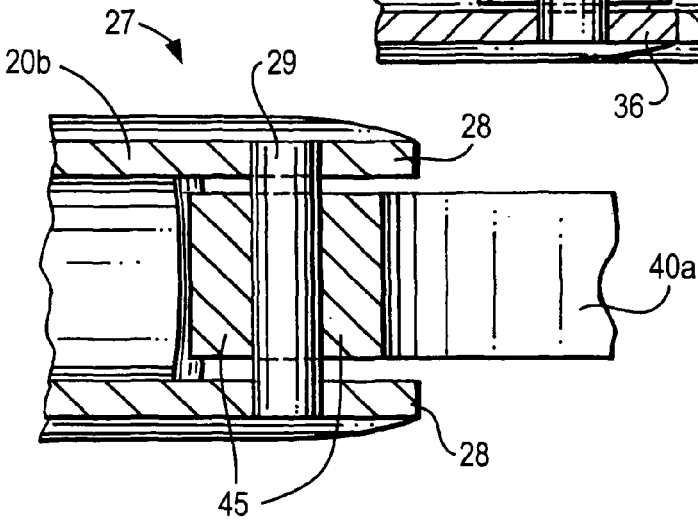
Figure 4:
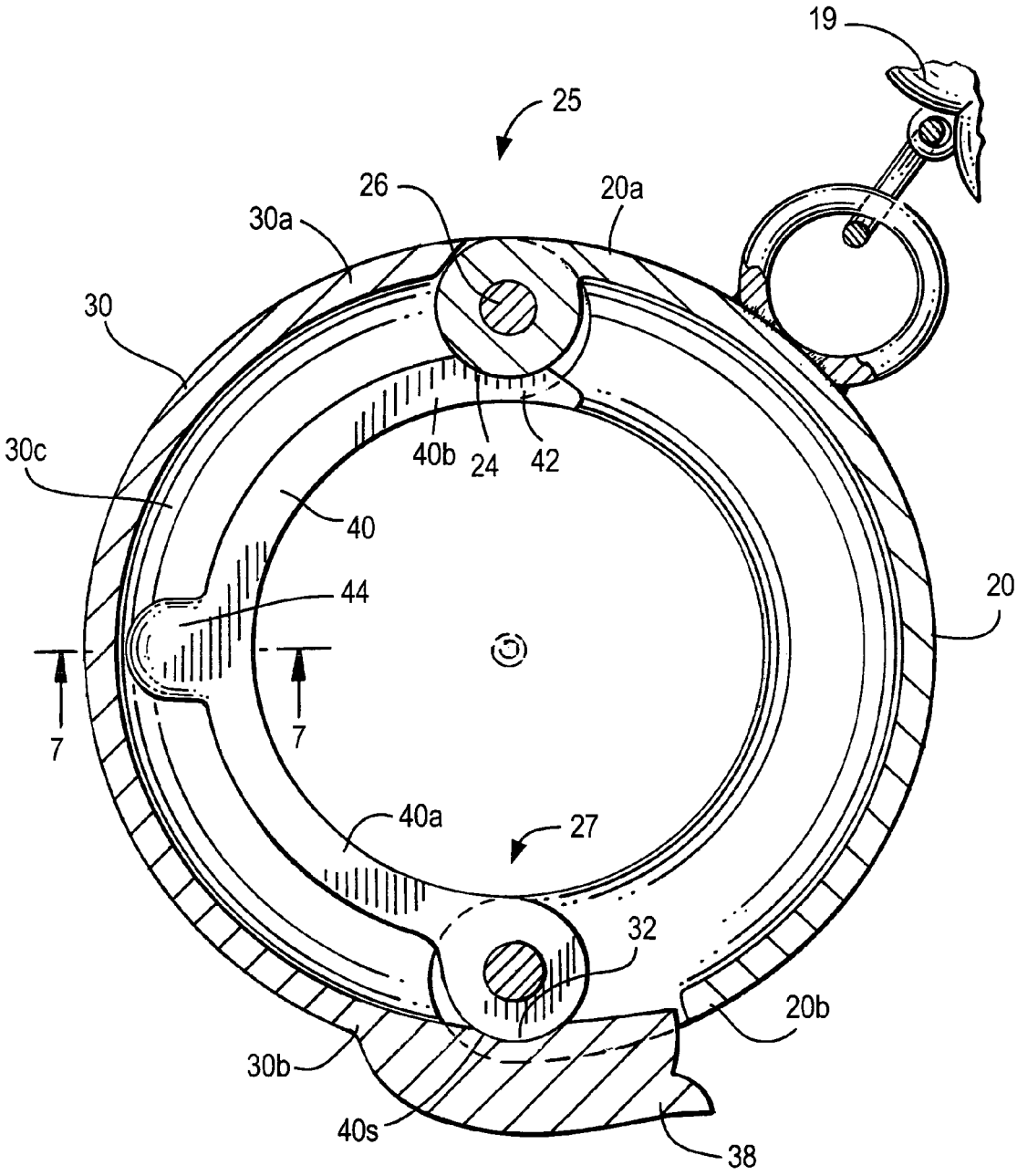
Figure 5:
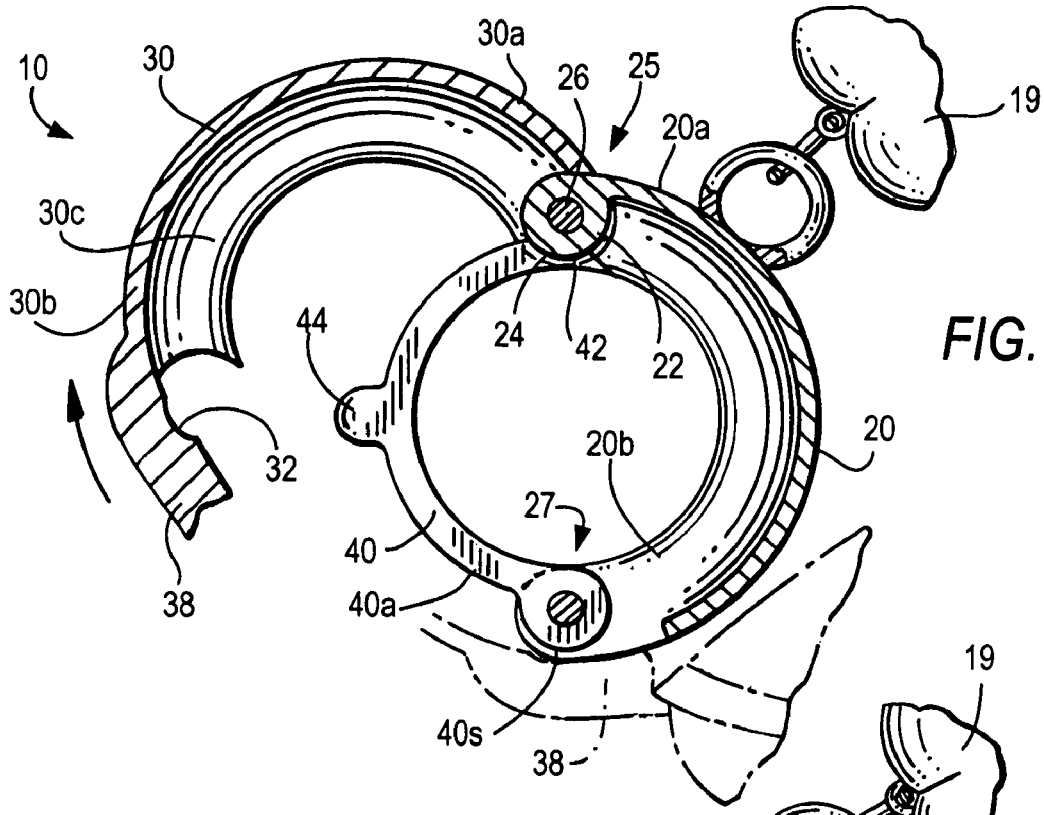
Figure 6:
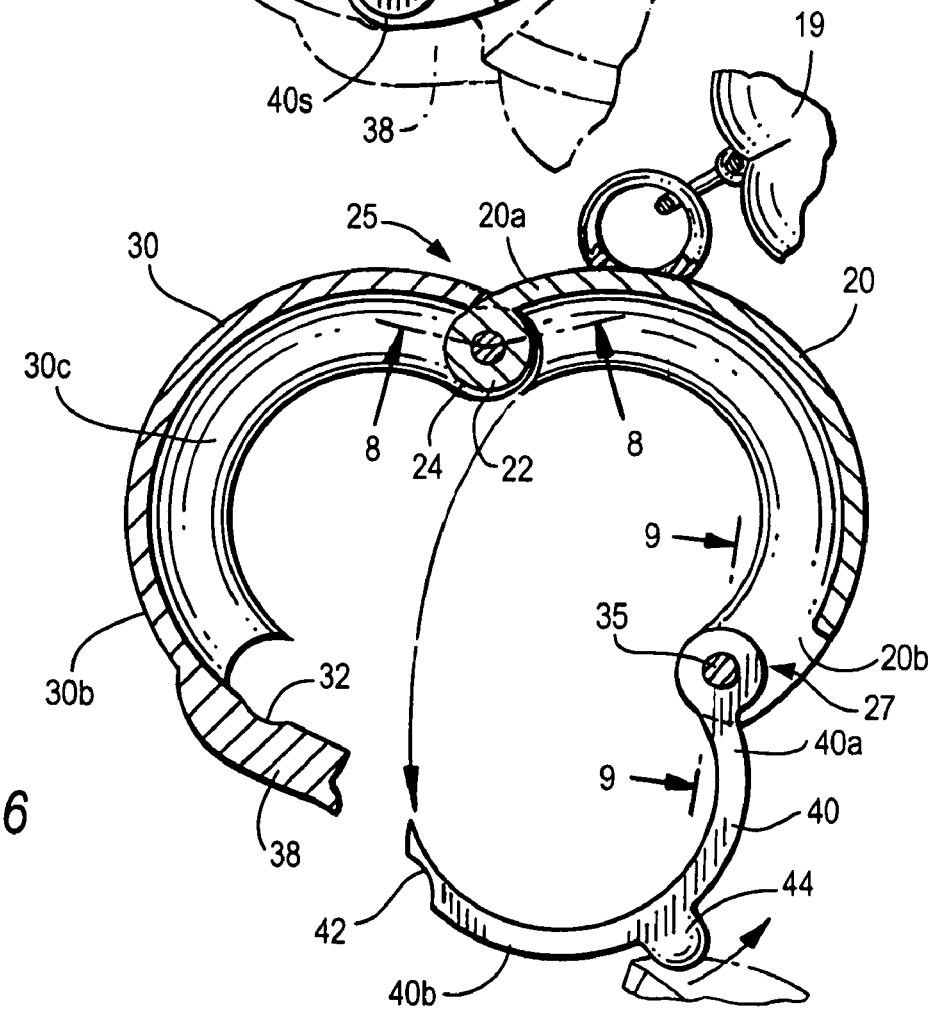

For a fuller understanding of the nature of the present invention, reference should be had to the following detailed description taken in connection with the accompanying drawings, in which:

FIG. 1 is a top front perspective view of the new charm clasp in its fully closed state coupled to a segment of a strand of pearls, FIG. 2 is a side elevation view of the charm clasp of FIG. 1 on a segment of a strand of pearls, FIG. 3 is an enlarged view partially in section of the clasp and segment of a strand of pearls of FIG. 2, FIG. 4 is a front elevation view in section of the clasp of FIGS. 1-3, taken along line 4-4 of FIG. 1 shown with both its outer and inner latch arms in closed state, FIG. 5 is a front elevation view, similar to FIG. 4, shown with the inner latch in closed state and the outer latch arm in open state, FIG. 6 is a front elevation view similar to FIG. 5, shown open with both the outer and inner latch arms in open state, FIG. 7 is a fragmentary sectional view taken along line 7-7 in FIG. 4, FIG. 8 is a fragmentary sectional view taken along line 8-8 in FIG. 5, and FIG. 9 is a fragmentary sectional view taken along line 9-9 in FIG. 6.

IV. DETAILED DESCRIPTION OF THE PREFERRED EMBODIMENTS

For convenience and clarity in describing these embodiments, similar elements or components appearing in different figures will have the same reference numbers.

As seen in FIGS. 1-3 the new charm clasp 10 in its closed and latched state is adapted to encircle or encompass a strand of pearls or beads 12 at any location along the length of the strand by generally overlying the adjacent ends of two adjacent beads 14, 16 and the spacer 18 between said beads. As later described herein, clasp 10 has its full closure state as seen in FIGS. 4, 1 and 2, its partial open state (same as partial closure state) as seen in FIG. 5, and it's fully open state as seen in FIG. 6.

As seen in FIGS. 4-9, clasp 10 comprises three basic components, namely:

(a) arcuate base element 20 having opposite ends 20*a*, 20*b*, (b) arcuate outer latch arm 30 having a proximal end 30*a* coupled via pivot joint 25 to the first end 20*a* of base element 20, and has a distal end 30*b* which includes hook or engaging recess 32, and (c) arcuate inner latch arm 40 having a proximal end 40*a* coupled via pivot joint 35 to second end 20*b* of said base element 20, and having distal end 40*b* which includes hook or engaging recess 42. Intermediate the proximal end 40*a* and distal end 40*b* of inner latch arm 40 is a projection 44 for a user to engage with her finger nail to pop open inner latch arm 40 when the charm clasp 10 is being disengaged from the strand.

As seen in FIGS. 5 and 7 pivot joint 25 is formed by a pair or spaced apart lugs 36 forming a yoke at end 30*a* of outer latch arm 30, tongue 22 at end 20*a* of base element 20, and pivot pin 26 extending transversely through lugs 36 and tongue 22. The outer surface of tongue 22 serves as a catch 24 for releasable latch engagement with hook or recess 42, as described later, As seen in FIGS. 5 and 9, pivot joint 27 is formed by a pair of spaced apart lugs 28 forming a yoke at end 20*b* of base element 20, blade 45 at proximal end 40*a* of inner latch arm 40, and pivot pin 29 extending transversely through lugs 28 and blade 45.

As seen in FIG. 4, the outer surface 40*s* of end 40*a* serves as a catch for releasable latch engagement with hook or recess 32, as described later. In said first stage partial closure of FIG. 5 inner latch arm 40 is pivoted and cooperates with base element 20 to encircle a small segment of a strand of pearls or beads, as seen in FIGS. 1-3. This partial closure is completed when hook or recess 42 at the distal end 40*b* of inner latch arm 40 resiliently engages catch 24, which in this embodiment is an outer surface of tongue 22 in pivot joint 25. The latching engagement of hook 42 and catch 24 is achieved by the resilient deflection radially inward of distal end 40*b* as inner latch arm 40 is pivoted clockwise to said first stage closure, and recess 42 is forced onto catch 24. This closure forms the circular collar 10 about the segment 12 of strand of pearls and serves as the first line of security for connecting a charm 19 to strand 12.

As seen in FIG. 4, the second and final stage of latching closure is achieved by pivoting outer latch arm 30 about pivot joint 25 until its distal end 30*b* approaches pivot joint 27. Outer latch arm 30 then overlies inner latch arm 20, and it establishes a closed circle with base element 20 about strand 12. In this position of latch arm 30, hook or recess 32 of distal end 30*b* of latch arm 30 resiliently engages catch 40*s*, which in this embodiment is an outer sleeve surface of arm 40 at pivot joint 27. This coupling is achieved by the resilient deflection radially outward of the distal end 30*b* of outer latch arm 30.

As seen in FIGS. 4 and 7 and also FIGS. 5 and 6, in this final latching phase outer latch arm 30, which overlies inner latch arm 40, is partially hollow with a slot or trough 30*c* in its inner circumferential surface. This slot slides over and encompasses inner latch arm 40 which becomes essentially invisible. What remains visible is the torus or donut shaped ring 10 formed by base element 20 and outer latch arm 30, this shape encircling as a collar, the adjacent edges of a set of adjacent pearls 14,16 as shown in FIGS. 1 and 2. This combination of a torus (the shape of the collar) and spheres (the shapes of the pearls) is aesthetically harmonious and particularly attractive, the torus being coaxial with the strand and with the central axis through the pearls, and the torus' round cross-section generally hugging the round spherical pearls. As seen in FIGS. 1, 2 and 4-6, after full closure, release edge 38 at the end 30*b* of the outer latch arm 30, extends outward from the torus surface. This edge is conveniently available for the user's finger nail to pop open latch arm 30, and thereafter the user can pop open latch arm 40 by engaging nail grip 44.

FIGS. 2 and 3 illustrate in side elevation view and in section, respectively, the relationship in this preferred embodiment of the charm clasp 10 to a strand of pearls 12, where the inside diameter $D_2$ of the torus shaped clasp must be smaller than the outside diameter $D_1$ of the pearls, but must be large enough to encircle the pearls without damaging the outer surfaces of the adjacent pearls where the clasp overlies said pearl surfaces. In the preferred embodiment seen in FIG. 3, clasp 10 has width W of about 3 mm, and inner diameter $D_2$ of about 6 mm for pearls of outside diameter $D_1$ of 7 mm, and clasp outer diameter $D_3$ of about 10 mm.

While the torus shape of circular cross-section is the preferred embodiment, the charm clasp illustrated herein can be made in various modified forms, as where the collar in cross-section is square, rectangular, oval, hemispherical and other shapes. Furthermore, hook 42 of inner latch arm 40 could engage a catch on or near proximal end 20*a* of base element 20 instead of engaging the outer surface 24 of tongue 22 of pivot joint 25. Similarly, hook 32 of outer latch arm 30 could engage a catch on or near the distal end 20*b* of base element 20 instead of engaging outer surface 40*s* of the proximal end 40*a* of arm 40 at pivot joint 27.

As seen in FIGS. 2 and 3, as the width W of collar 10 is increased, inner diameter $D_2$ must increase in order for collar 10 to fit over and onto two adjacent beads 14, 16. Obviously, however, there will be a limit to width W, because if $D_2$ becomes too large collar 10 will slide freely along the strand and thus not be restricted to a chosen location.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims which include but are not limited to pearl bracelets and necklaces and strands of pearls or other beads generally.

The invention claimed is:

1. A charm clasp for a strand of generally spherical beads, comprising:

a. an arcuate base element extending circumferentially about 180° and having inner and outer radii, opposite first and second ends, and first and second catch means on said first and second ends respectively, b. an arcuate outer latch arm extending circumferentially about 180° and having an inner and outer radii substantially the same as inner and outer radii of said base element and having a proximal end pivotally coupled to said first end of said base element forming a first pivot joint and an opposite distal end with a hook thereon, c. an arcuate inner latch arm extending circumferentially about 180° having an inner radius substantially the same as the inner radius of said base element, having a proximal end pivotally coupled to said second end of said base element forming a second pivot joint, and having an opposite distal end with a hook thereon, d. said inner latch arm having:

(i) a closed state where its distal end is releasably coupled to said first catch means on said first end of said base element, and where said inner latch arm and said base element together form a closed annular collar, and (ii) an open state where said inner latch arm is pivoted away from said first end of said base element, e. said outer latch arm having a closed state where (i) its distal end is releasably coupled to said catch means on said second end of said base element, and where said outer latch arm and said base element together form a closed annular collar, and (ii) an open state where its distal end is pivoted away from said second end of said base element, said outer latch arm being pivotable to its closed state only after said inner latch arm is pivoted to its closed state.

2. A charm clasp according to claim 1, wherein each of said hooks is resiliently deflectable when it engages a corresponding catch means.

3. A charm clasp according to claim 1, wherein each of said hooks of said inner and outer arms respectively comprises a narrowed part of said distal end that is resiliently deflectable relative to the remainder of said inner and outer latch arm respectively.

4. A charm clasp according to claim 1, wherein said base element and said outer latch arm each has in cross-section a generally C shape along its circumferential length between its ends thus creating a generally torus shape by said base element and said outer latch arm when said outer latch arm is in its closed state.

5. A charm clasp according to claim 1, wherein said outer latch arm has an inside circumferential surface that includes a slotted recess along its length, which in the closed state of said outer latch and inner latch, respectively, overlies and encompasses the sides and outer circumference of said inner latch arm.

6. A charm clasp according to claim 5, wherein said base element has an inside circumferential surface that includes a slotted recess along its length.

7. A charm clasp according to claim 1, wherein said first pivot joint comprises a pair of spaced apart lugs at the proximal end of said outer latch arm forming a yoke, a tongue at said first end of said base element and situated between said pair of lugs, and a pivot pin extending transversely through said pair of lugs and tongue of said first pivot joint.

8. A charm clasp according to claim 7, wherein said first catch means comprises an outer surface portion of said tongue of said first pivot joint.

9. A charm clasp according to claim 1, wherein said second pivot joint comprises a pair of spaced apart lugs at the second end of said base element forming a yoke, a tongue at said proximal end of said inner latch arm and situated pivot between said pair of lugs, and a pivot pin extending transversely through said pair of lugs and tongue of said second pivot joint.

10. A charm clasp according to claim 9, wherein said second catch means comprises an outer surface portion of said tongue of said second pivot joint.

11. A charm clasp according to claim 1, further comprising an eyelet element on an outer circumferential surface of one of said base element and said outer latch arm.

12. A charm clasp according to claim 11, wherein said base element and outer latch arm in its closed state define a closed round circular ring.

13. A charm clasp according to claim 12, wherein said ring has a torus shape.

14. A charm clasp according to claim 1, wherein said hook of said outer latch arm and said second catch means of said base element each have width less than the diameter of said outer latch arm and of said base element respectively.

15. A charm clasp according to claim 1 wherein said strand of generally spherical beads comprises a pearl necklace or a bracelet.

16. A charm clasp according to claim 1, wherein said first and second hooks each comprises a recess in the surface of said distal end of said outer and inner latch arms respectively, and said first and second catch means each comprises a surface extending transversely of said recess for releasable engagement into said recess.

17. A charm clasp, comprising:

a. an arcuate base element extending circumferentially about 180° , and having inner and outer radii, opposite first and second ends, and first and second catch means at said first and second ends respectively, b. an arcuate outer latch arm extending circumferentially about 180° and having a proximal end pivotally coupled to said first end of said base element and an opposite distal end with hook thereon, and c. an arcuate inner latch arm extending circumferentially about 180° and having an inner radius substantially the same as the inner radius of said base element, having a proximal end pivotally coupled to said second end of said base element and an opposite distal end with a hook thereon, d. said inner latch arm having a closed state where its distal end is releasably coupled to said first catch means on said first end of said base element, and an open state where its distal end is pivoted away from said first end of said base element, and e. said outer latch arm having:

(i) a closed state where its distal end is releasably coupled to said catch means on said second end of said base element, and where said outer latch arm end of said base element together form a torus, and (ii) an open state where its distal end is pivoted away from said second end of said base element, said outer latch arm being pivotable to its closed state only after said inner latch arm is pivoted to its closed state.

* * * * *